US006036456A

United States Patent [19]

Peters et al.

[11] Patent Number: 6,036,456

[45] Date of Patent: Mar. 14, 2000

[54] ELECTRICAL AIR PUMP ADAPTED FOR BEING PERIODICALLY TURNED ON AND OFF AND REVERSED IN PUMPING DIRECTION

[75] Inventors: Rainer Peters, Goch; Gunter Van De Venne, Mönchengladbach; Michael Bonse, Düsseldorf; Klaus Muckelmann, Hilden, all of Germany

[73] Assignee: Pierburg AG, Neuss, Germany

[21] Appl. No.: 09/154,393

[22] Filed: Sep. 16, 1998

[30] Foreign Application Priority Data

Sep. 16, 1997 [DE] Germany ..... 197 405 827

[51] Int. Cl.[7] ..... F04B 17/00

[52] U.S. Cl. ..... 417/423.3; 417/423.7; 417/423.14

[58] Field of Search ..... 123/198 D; 417/423.7, 417/423.15, 423.14

[56] References Cited

U.S. PATENT DOCUMENTS

| | | | |
|---|---|---|---|
| 3,933,416 | 1/1976 | Donelian | 417/354 |
| 4,752,194 | 6/1988 | Wienen et al. | 417/423.7 |
| 5,141,410 | 8/1992 | Fujii | 417/423.7 |
| 5,291,087 | 3/1994 | Pollock et al. | 310/86 |
| 5,356,272 | 10/1994 | Nagata et al. | 417/423.7 |
| 5,723,932 | 3/1998 | Ito et al. | 417/423.7 |

FOREIGN PATENT DOCUMENTS

| | | |
|---|---|---|
| 2042356 | 3/1971 | Germany . |
| 4440495 | 5/1996 | Germany . |

*Primary Examiner*—John Kwon
*Attorney, Agent, or Firm*—Ladas & Parry

[57] ABSTRACT

An electrical air pump adapted for being periodically turned on and off and reversed in pumping direction. The air pump includes an electric motor adapted for electronic control and an air pump section joined by a housing as a common system. The housing has a cylindrical wall defining a first chamber in which the stator system is received and a scaling cover is engaged with the housing to seal the first chamber. The air pump section includes a pump cover sealingly engaged with the housing and defining therewith a second chamber, the rotor being of bell shape and rotatably supported in the second chamber on a pin secured in the housing and in the pump cover. The rotor is disposed with slight clearance adjacent to an end wall of the housing and the rotor projects radially beyond the cylindrical wall. The rotor has a collar and a plurality of pumping blades extending radially from the collar into an annular pumping channel of the second chamber. The pump cover has two connections, one for aspirating air and the other for discharging air under pressure, connected to the annular channel and angularly spaced from one another. The pump cover has a wall with a separating section of locally increased thickness between the two connections.

20 Claims, 3 Drawing Sheets

ELECTRICAL AIR PUMP ADAPTED FOR BEING PERIODICALLY TURNED ON AND OFF AND REVERSED IN PUMPING DIRECTION

FIELD OF THE INVENTION

The invention relates to an electrical air pump adapted for being periodically turned on and off and reversed in pumping direction.

The electrical air pump is particularly adapted for use in apparatus for periodically cleaning or purging a charcoal canister in an air supply of an internal combustion engine and for periodically checking leak-tightness of a fuel tank system of the internal combustion engine.

Such apparatus is disclosed in commonly owned copending application Ser. No. 09/038,430 filed Apr. 11, 1998, the contents of which are incorporated by reference herein. In such apparatus, cleaning air is pumped by an electrical air pump through the charcoal canister into the intake manifold of the engine at a location upstream of a choke valve and when leak-tightness of the fuel tank system is to be tested, the pumping direction of the electrical air pump is reversed. During routine operation, the electrical air pump is shut off.

The electrical air pump therefore must be of a construction by which it can be switched on and off and reversed in pumping direction by signals received from a control program of an electronic control device.

SUMMARY OF THE INVENTION

An object of the invention is to provide an electrical air pump which will be suitable for use in a system as described above and wherein the electrical air pump is periodically turned on and off and periodically reversed in direction.

Such electrical air pump must be of a robust construction which will enable it to undergo the frequent on off operations and reverse pumping directions over the life of the vehicle and be inexpensive to manufacture and suitable for mass production.

In accordance with the above objects and further objects, the invention provides an electrical air pump for periodic cleaning of a charcoal canister and for periodic checking of leak-tightness of a fuel tank system of an internal combustion engine wherein the air pump comprises an electric motor section adapted for being electronically controlled and an air pump section joined in a housing as a common system; the air pump section includes a rotor and the motor section includes a stator system, the housing has a cylindrical wall defining a first chamber in which the stator system is received, a sealing cover engaged with the housing to seal the first chamber, the sealing cover including means for passage of the electrical leads of the motor from the stator outside the electrical air pump. The air pump section includes a pump cover sealingly engaged with the housing and defining therewith a second chamber, including an annular pumping channel. The rotor is of bell shape and is rotatably supported in the second chamber on a pin secured in the housing and in the pump cover. The housing has an end wall from which the cylindrical wall extends and the rotor is disposed with slight clearance adjacent to the end wall and includes pumping blades projecting radially from a collar into the pumping channel of the second chamber. The pump cover has two connections, one for aspirating air and the other for discharging air under pressure, the connections being connected to the annular channel and angularly spaced from one another, the pump cover including a wall with a separating section disposed between the two connections.

It is a feature of the invention that the separating section of the wall is locally thickened.

DETAILED DESCRIPTION OF A PREFERRED EMBODIMENT

Figure 1:
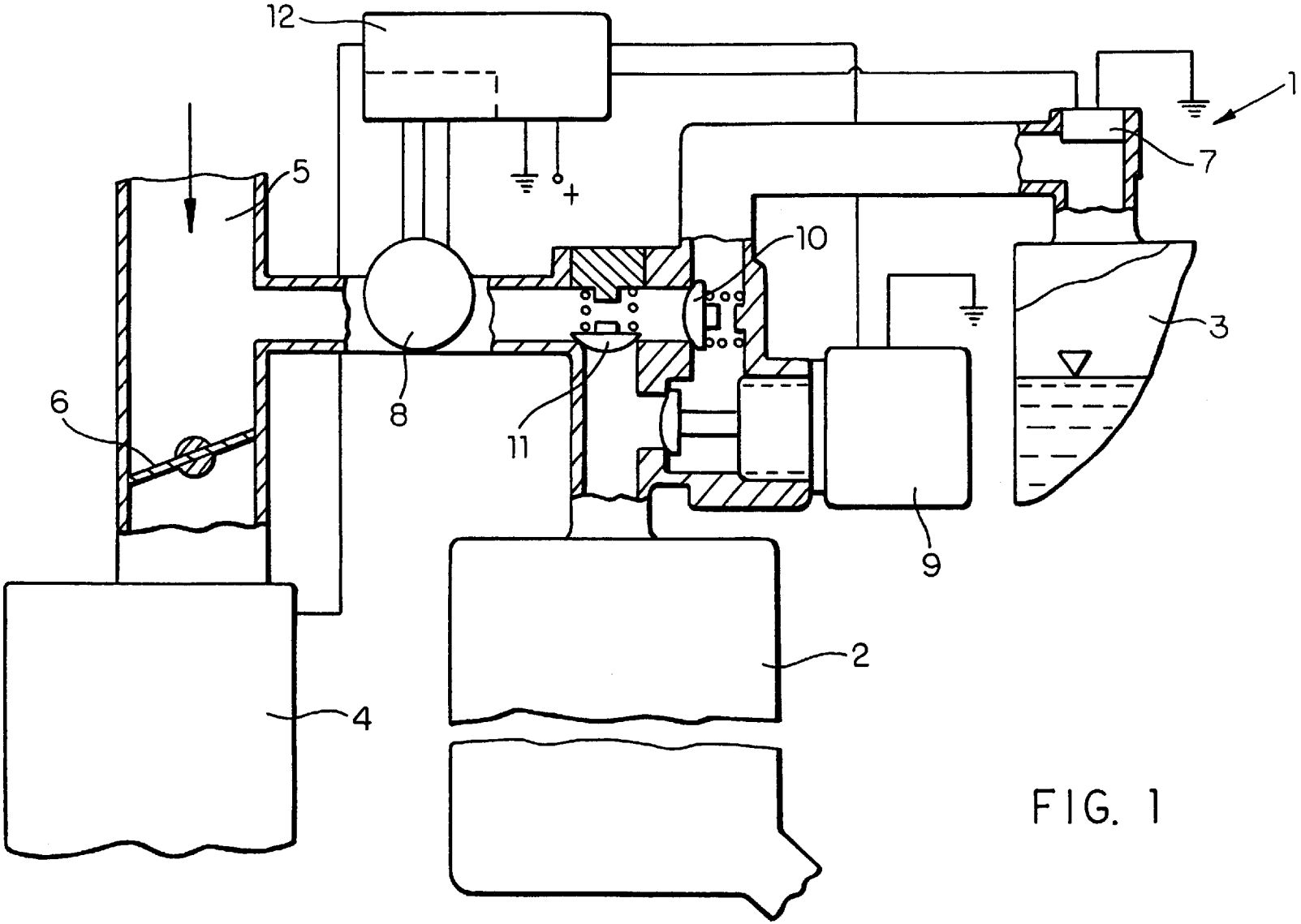
FIG. 1 is a diagrammatic illustration of apparatus for periodically cleaning a charcoal canister and for periodically testing leak-tightness of an internal combustion engine.

FIG. 1 shows apparatus for the periodic cleaning of a charcoal canister of an internal combustion engine and for periodically testing for leak-tightness of the fuel tank system of the engine. The apparatus is described in detail in commonly owned application Ser. No. 09/038,430 filed Apr. 11, 1998, the contents of which are incorporated by reference herein. The present invention is particularly concerned with the construction of the electrical air pump in the apparatus.

Referring to FIG. 1, the apparatus 1 is constructed for periodically cleaning a charcoal canister 2 of an evaporative emission system of the internal combustion engine 4 of a motor vehicle and for periodically testing leak-tightness of the fuel tank assembly 3 of a closed fuel system of the engine. The charcoal canister includes an activated carbon filter to trap fuel vapor coming from the head space of the closed fuel tank as well known in the art. In order to clean the charcoal canister 2, air is drawn in from the ambient atmosphere and is passed through the filter in the canister to wash the filter of trapped fuel vapor and convey the air containing the fuel vapor to an air intake manifold 5 upstream of a choke valve 6; testing of leak-tightness of the fuel tank system is obtained by establishing test pressure in the hermetically sealed system 3 after which measurement of any decrease in pressure is detected by a pressure sensor 7 over a predetermined time interval to provide information on leak-tightness.

The cleaning air for washing the filter in canister 2, is pumped by an electrical air pump 8 whose pumping direction is reversed during leak-tightness testing of the fuel tank system. The construction of the air pump 8 will be described in detail later.

If the pumping direction of the electrical air pump 8 is reversed and an on-off valve 9 is closed and the running internal combustion engine turned off, air for testing leak-tightness is conveyed from intake manifold 5 through an open pressure valve 10 directly into the fuel tank system while a suction valve 11 is closed by the pressure produced by the electrical air pump 8. When a specific predetermined pressure difference is reached, relative to atmospheric pressure, the electrical air pump 8 is switched off and any pressure drop produced over a predetermined time interval is evaluated for determining whether fuel tank system 3 is leak-tight or not.

The determination of leak-tightness of tank system 3 can either be stored as a diagnostic value in a control device 12 or it can be indicated acoustically or visually on a display.

Figure 2:
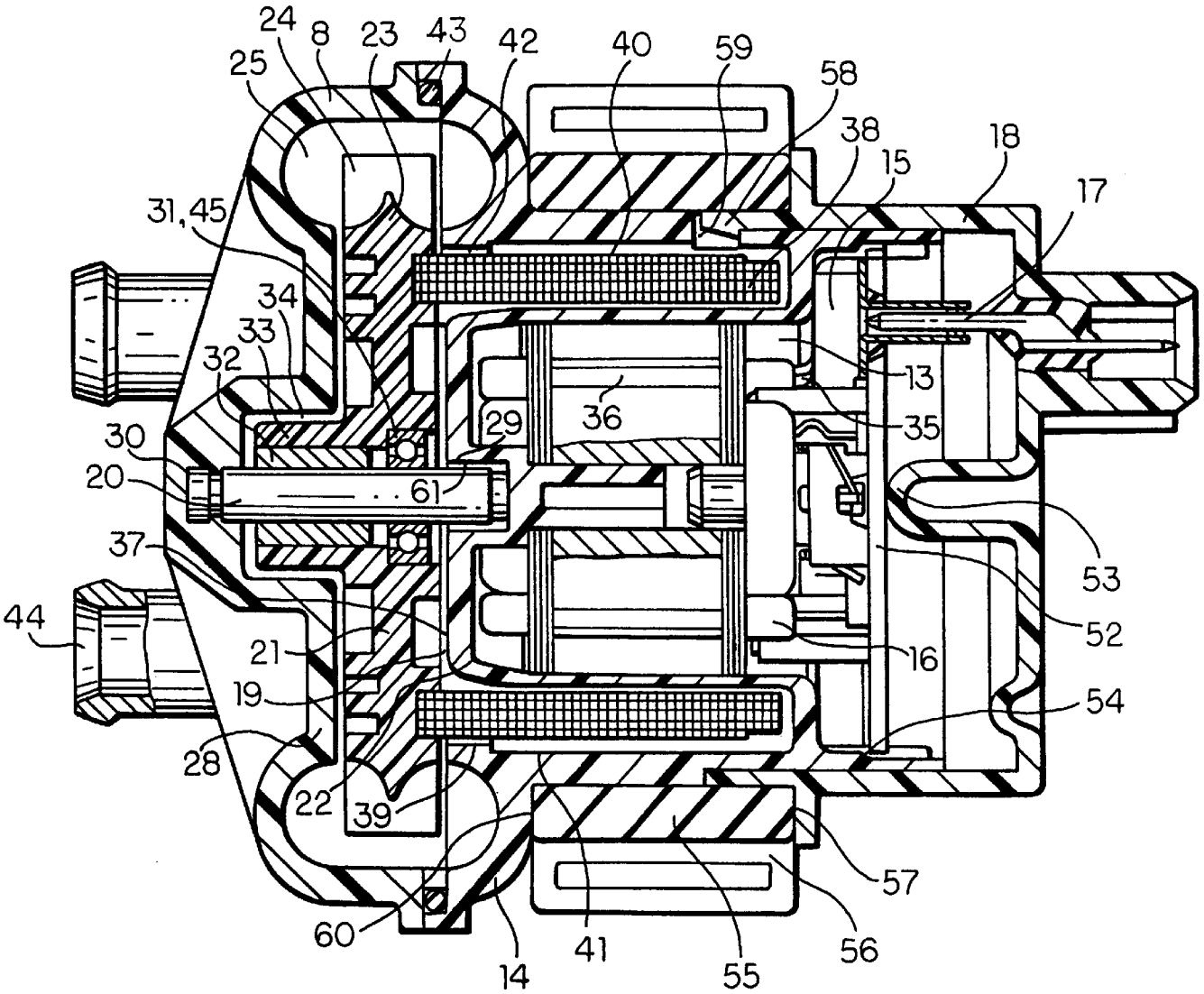
FIG. 2 is a longitudinal sectional view through an electrical air pump according to the invention which can be used in the apparatus of FIG. 1.

FIG. 2 shows the electrical air pump 8 according to the invention in a longitudinal sectional view. The electrical air pump 8 comprises an electronically operated electrical motor 13, which is combined with an air pump section in a common housing 14. In the housing 14, a first chamber 15 is formed in which a stator system 16 of motor 13 is arranged, and electrical power leads 17 are connected to the stator system and exit from the pump through a sealing cover 18 which hermetically seals chamber 15.

Figure 3:
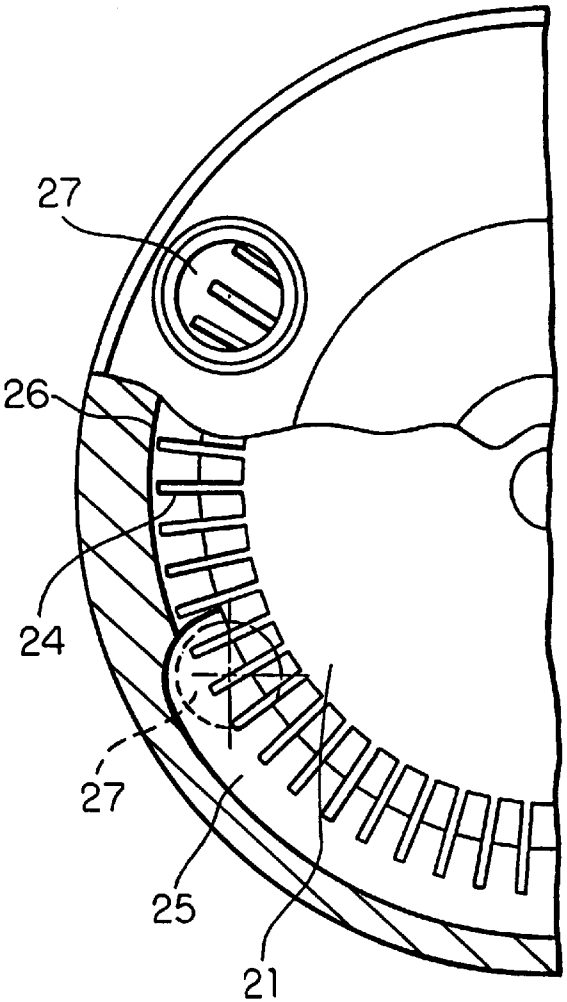
FIG. 3 is a plan view of a portion of the electrical air pump of FIG. 2, partly broken away and in section.

A second chamber 19 is formed in the air pump section and a bell-shaped rotor 21 is rotatably supported in the air pump section on a fixed pin 20. The rotor 21 passes with slight clearance above an end wall 37 of a cylindrical wall 22 of the housing 14. The rotor 21 has a collar 23 from which extend a number of radial pumping blades 24 as is conventional in centrifugal pumps. The blades 24 are received in an annular pumping channel 25, whose outer wall has a thickened section 26 between two angularly, spaced fluid connections 27 as shown in Figure 3. In one of the connections 27 fluid is aspirated into channel 25 and in the other of the connections the fluid is discharged under pressure from channel 25. Fluid flow is reversed in the connections 27 when the rotor is reversed in its direction of rotation.

The annular channel 25 is formed at one side by housing 14 and at its other side by a pump cover 28. Pin 20 is secured at one end in a bore 29 in housing 14 and at the other end in a bore 30 in pump cover 28. Rotor 21 is rotatably supported on pin 20 by means of two bearings 31, 32. Rotor 21 has a hub 33, which projects into a corresponding recess 34 in pump cover 28, for enlarging the length of bearing 32.

The stator system 16 is held securely against rotation by ribs 35, which extend radially inwards from cylindrical wall 22 and the ribs engage in corresponding grooves 36 formed in the stator system 16. The ribs 35 also serve the purpose of reinforcing the relatively thin cylindrical wall 22.

The wall 22, in combination with end wall 37 of the housing 14 separates and bounds first chamber 15 and second chamber 19.

As has already been mentioned, rotor 21, which is formed with a bell shape, is arranged in chamber 19 on pin 20 and projects radially beyond cylindrical wall 22, and with small spacing adjacent to end wall 37. The rotor 21 carries a magnetic ring 38 which can be integrally formed with the rotor by injection molding or by being press-fit therein. The rotor 21 is made of plastic. The magnetic ring 38 has on its inner peripheral surface a multi-polar circumferential magnetization and is driven in rotation, by the magnetic field produced in stator system 16 when electrical current is supplied to the electric motor.

Advantageously, housing 14 has a crimped edge 39, which covers a gap 42 between outer surface 40 of magnetic ring 38 and a cylindrical surface 41 of housing 14 which bounds chamber 19, so that magnetic losses are minimized.

Cylindrical wall 22 extending between stator system 16 and magnetic ring 38 of rotor 21 is very thin, so that a very constricted iron-free gap is produced and thus there are only small magnetic loop losses. Thereby, the number of windings and/or the magnitude of current supplied to the motor can be minimized. An elastic gasket 43 is inserted between housing 14 and pump cover 28 and the gasket is elastically deformed by the joining force between housing 14 and pump cover 28. Any suitable type of connection, for example, a bayonet turn-lock fastener or a permanent welding connection can be provided between the housing 14 and the pump cover 28.

The two fluid connections 27 have conical openings 44, to minimize noise buildup. Housing 14, cover 18, pump cover 28, and rotor 21 may be made of plastic material, preferably polyphenylene sulfide. In order to avoid the expense of costly polyphenylene sulfide, the cover 18 may be made of a less expensive plastic.

In order to limit the axial play of rotor 21 on pin 20, one of bearings 31, 32 of rotor 21 is designed as a ball bearing 45.

FIG. 3 shows the arrangement of annular channel 25, separating section 26, blades 24 of rotor 21 and the two connections 27.

Figure 4:
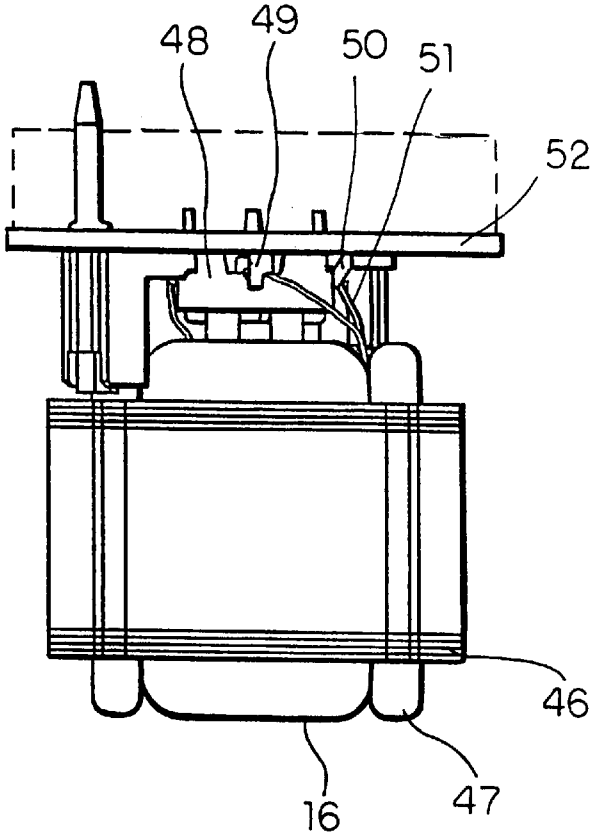
FIG. 4 is an elevational view of a stator system of the electrical air pump.

FIG. 4 shows the complete stator system 16 with individual plates 46 and coils 47. A middle part 48 made of plastic is press-fit into stator system 16, and several contact elements 49, which have hooks 50, which are welded to ends 51 of the coils 47, are in this middle part. In this way a cost-favorable manufacture is obtained.

A printed circuit board 52 is engaged on middle part 48 and an electrical connection thereof to contact elements 49 is made by soldering.

The complete stator system 16 is securely held in the motor section by a finger 53 on cover 18 which engages against the printed circuit board 52 and holds the board against support surfaces 54 on housing 14 as shown in FIG. 2.

Alternatively, instead of finger 53, a separate screw member (not shown) can be threaded in the cover 18.

As also can be seen from FIG. 2, electric air pump 8 can be provided with an elastic coupling ring 55, which is attached to housing 14 for isolating noise produced in the electric air pump. The ring 55 is connected to a holder 56 for mounting the electric air pump at an attachment site in the vehicle.

It may be provided that coupling ring 55 is made of elastic material and is compressed between abutment surfaces formed on a shoulder 57 of cover 18 and a wall 60 of housing 14 when the cover 18 is installed on the housing 14. Thereby, the housing 14 and cover 18 will be elastically connected via ring 55. Cover 18 is connected to housing 14 by engaging clips 58 on cover 18 in recesses 19 of housing 14. The arrangement of the clips and recesses can be reversed if suitable and when cover 18 is installed on housing 14, chambers 15 and 19 are sealed relative to the atmosphere by the elastic action of ring 55 against wall 60 which compresses seal 43.

As already mentioned, housing 14 may be made of an expensive plastic material and cover 18 from an inexpensive plastic material, whereby the latter may be subjected to a deformation during mounting, but will be adapted to the rigid housing 14.

Pin 20 may be secured to pump cover 28 by injection molding therewith or it may be press-fit in bore 29 in housing 14, in which case longitudinal ribs 61 are provided in bore 29 and the ribs are deformed when pin 20 is inserted into bore 29.

Although the invention is disclosed with reference to a particular embodiment thereof, it will become apparent to those skilled in the art that numerous modifications and variations can be made which will fall within the scope and spirit of the invention as defined by the attached claims.

What is claimed is:

1. An electrical air pump for use in apparatus for periodic cleaning of a charcoal canister and periodic checking of leak-tightness of a fuel tank system of an internal combustion engine in which the air pump is periodically turned on and off and reversed in pumping direction, said air pump comprising:

an electric motor adapted for electronic control thereof, an air pump section, a housing joining said motor and pump section as a common system, said air pump section including a rotor, said motor including a stator system, said housing having a cylindrical wall defining a first chamber in which said stator system is received, a sealing cover engaged with said housing to seal said first chamber, said sealing cover including means for passage of electrical leads from said stator outside the electrical air pump, said air pump section including a pump cover sealingly engaged with said housing and defining therewith a second chamber, said rotor being of bell shape and rotatably supported in said second chamber, a pin secured in said housing and said pump cover, said rotor being rotatably supported on said pin, said housing having an end wall from which said cylindrical wall extends, said rotor being disposed with slight clearance adjacent to said end wall and projecting radially beyond said cylindrical wall of said housing, said rotor including a collar and a plurality of pumping blades extending radially from said collar into an annular channel of said second chamber, said pump cover including two connections, one for aspirating air and the other for discharging air under pressure, said connections being connected to said annular channel and angularly spaced from one another, said pump cover including a wall with a separating section disposed between said two connections.

2. An electrical pump as claimed in claim 1, wherein said annular channel is formed in part by opposed portions of said pump cover and said housing, said pin being engaged at its ends in respective bores provided in said pump cover and said housing.

3. An electrical pump as claimed in claim 2, wherein said rotor includes a hub, bearing means including two bearings, between said pin and said hub, said hub extending into a recess formed in said pump cover thereby providing extended length for said bearing means.

4. An electrical pump as claimed in claim 3, wherein one of said bearings is a ball-bearing for limiting axial play for said rotor on said pin.

5. An electrical pump as claimed in claim 1, comprising radial ribs extending inwardly from said cylindrical wall of said housing and engaged in grooves provided in said stator system to oppose rotation in said stator system and to reinforce said cylindrical wall.

6. An electrical pump as claimed in claim 1, comprising a magnetic ring carried by said rotor and facing said stator system, said rotor being made of plastic material and said magnetic ring being secured to said rotor.

7. An electrical pump as claimed in claim 6, wherein said magnetic ring has an inner peripheral surface facing said stator system which is provided with multipolar magnetization arranged circumferentially around said peripheral surface.

8. An electrical pump as claimed in claim 6, wherein an iron-free air gap is formed between an inner surface of said housing and an outer surface of said magnetic ring, said housing including a crimped edge which covers said gap to minimize magnetic losses.

9. An electrical pump as claimed in claim 1, wherein said connections have conical openings to avoid noise generation.

10. An electrical pump as claimed in claim 1, wherein said housing, said rotor and said pump cover are made of plastic material.

11. An electrical pump as claimed in claim 10, wherein said plastic material is polyphenylene sulfide, said sealing cover being made of plastic material.

12. An electrical pump as claimed in claim 1, wherein said stator system includes a middle part made of plastic and secured by being press-fit in said stator system, said middle part including contact elements connected to ends of coils of said stator system, and a printed circuit board secured in said stator system and connected to said contact elements.

13. An electrical pump as claimed in claim 1, comprising an elastic coupling ring on said housing and a holder connected to said ring for connecting the electrical air pump to an outside structure.

14. An electrical pump as claimed in claim 13, wherein said housing and said sealing cover have opposed walls with abutment surfaces between which said elastic coupling ring is compressed when the sealing cover is engaged on said housing.

15. An electrical pump as claimed in claim 14, wherein said sealing cover includes inwardly facing clips and said housing has recesses receiving said clips when said sealing cover is engaged with said housing, said elastic ring being compressed when said clips are engaged in said recesses.

16. An electrical pump as claimed in claim 15, comprising a sealing member between said housing and said pump cover, said sealing member being compressed when said clips are engaged in said recesses and said elastic mounting ring is compressed.

17. An electrical pump as claimed in claim 1, wherein said housing is made of a relatively expensive plastic material and said sealing cover is made of a relatively inexpensive plastic material.

18. An electrical pump as claimed in claim 1, wherein said pin is injection molded in said pump cover and is press-fit in said housing.

19. An electrical pump as claimed in claim 18, wherein said housing has a bore into which an end of said pin is press-fit, said bore having longitudinal ribs which are deformed when said pin is press-fit in said bore.

20. An electrical pump as claimed in claim 1, wherein said separating section of said wall of said pump cover is locally thickened compared to the remainder of said wall.

* * * * *